US005831339A

United States Patent [19]

Lefumeux et al.

[11] Patent Number: 5,831,339

[45] Date of Patent: Nov. 3, 1998

[54] CONTINUOUS PROCESS FOR SOLVENT-FREE MANUFACTURE OF HEAT-CURABLE COMPOSITE PYROTECHNIC PRODUCTS

[75] Inventors: Alain Lefumeux, Orsay; Dominique Wiencek, Cerny, both of France

[73] Assignee: Societe Nationale des Poudres et Explosifs, Paris Cedex, France

[21] Appl. No.: 839,060

[22] Filed: Apr. 23, 1997

[30] Foreign Application Priority Data

May 23, 1996 [FR] France ..... 96 06397

[51] Int. Cl.[6] ..... C06B 21/00

[52] U.S. Cl. ..... 264/3.3; 264/3.1; 264/3.4; 149/109.6

[58] Field of Search ..... 264/3.1, 3.3, 3.4, 264/3.5; 149/109.6

[56] References Cited

U.S. PATENT DOCUMENTS

| | | | |
|---|---|---|---|
| 2,995,432 | 8/1961 | Corley et al. | 52/0.5 |
| 4,098,627 | 7/1978 | Tompa et al. | 149/109.6 |
| 4,177,227 | 12/1979 | Harvey et al. | 264/3 R |
| 4,375,522 | 3/1983 | Braun | 523/180 |
| 4,405,534 | 9/1983 | Ulf-Deisenroth | 264/3 C |
| 4,650,617 | 3/1987 | Kristofferson | 264/3.3 |
| 4,657,607 | 4/1987 | Perotto et al. | 149/19.4 |
| 4,726,919 | 2/1988 | Kristofferson | 264/33 |
| 4,776,993 | 10/1988 | Chang et al. | 149/109.6 X |
| 4,889,571 | 12/1989 | Willer et al. | 149/19.9 |
| 4,963,296 | 10/1990 | Niedermeter et al. | 264/3.2 |
| 4,994,212 | 2/1991 | Vos et al. | 264/3.3 |
| 5,035,843 | 7/1991 | Schmid | 264/3.2 |
| 5,486,248 | 1/1996 | Taylor et al. | 149/109.6 |
| 5,596,232 | 1/1997 | Lefumeux | 264/3.2 |

FOREIGN PATENT DOCUMENTS

| | | |
|---|---|---|
| 0417912 | 3/1991 | European Pat. Off. . |
| 8906258 | 7/1989 | WIPO . |

*Primary Examiner*—Peter A. Nelson
*Attorney, Agent, or Firm*—Bucknam and Archer

[57] ABSTRACT

The present invention relates to the field of the continuous manufacture of composite pyrotechnic products.

A heat-curable liquid binder (3) is mixed with a thickening filler (4) in a mixer (1) so as to obtain a viscous premix (2) which is unreactive at ambient temperature and which can be subsequently mixed with oxidizing fillers (17) to give, after extrusion and chopping, intermediate products (24) which are not yet crosslinked but which have stable geometrical dimensions. The structure of the products (24) is subsequently set by crosslinking the binder in an oven (26).

The invention permits the continuous industrial manufacture in series of small crosslinked composite pyrotechnic charges without any "pot life" constraint since the binder does not change at ambient temperature.

11 Claims, 2 Drawing Sheets

CONTINUOUS PROCESS FOR SOLVENT-FREE MANUFACTURE OF HEAT-CURABLE COMPOSITE PYROTECHNIC PRODUCTS

The present invention relates to the field of composite pyrotechnic products and especially of plastic-bonded powders for firearms, plastic-bonded propellants for rocket motors and plastic-bonded explosives for munitions charges. More precisely the invention relates to a continuous process for solvent-free manufacture of such pyrotechnic products comprising a heat-curable binder.

The composite pyrotechnic products consisting of an organic binder and of a pulverulent energetic filler which may be an inorganic filler like, for example, ammonium nitrate, ammonium perchlorate or potassium perchlorate, or else an organic filler and especially a nitramine such as RDX, HMX, nitroguanidine or 2,4,6,8,10,12-hexanitro-2,4,6,8,10,12-hexaazatetracyclo-[5.5.0.0$^{5,9}$.0$^{3,11}$]dodecane, also called hexanitrohexaazaisowurtzitane are highly sought after by a person skilled in the art because of their high chemical stability and their low sensitivity to impact and to thermal stresses.

Furthermore, for reasons of safety and of reproducibility of manufacture, a person skilled in the art prefers continuous processes to noncontinuous processes.

The binders that can be employed for the manufacture of composite pyrotechnic products may be thermoplastic binders or heat-curable binders.

The thermoplastic binders have the advantage of lending themselves relatively easily to a continuous use by virtue of the fact that they soften when the temperature is raised. Thus, French Patent Application FR-A-2 723 086 describes a process for continuous and solvent-free manufacture of composite pyrotechnic products based on binders of thermoplastic type. Nevertheless, binders of thermoplastic type have the disadvantage of resulting in products which have a poor temperature behaviour for the very reason that the binder softens when there is a rise in temperature. However, for some applications like, for example, arms with a fast rate of fire, a person skilled in the art requires pyrotechnic products which have a good temperature behaviour.

From this point of view the pyrotechnic products with a heat-curable binder offer the advantage of having a good temperature behaviour.

However, for the very reason that their binder cures irreversibly by crosslinking when heated, these products have the disadvantage of not lending themselves well to continuous processes.

These products are therefore often applied by means of noncontinuous processes. Thus U.S. Pat. No. 4,128,441 describes a process for noncontinuous manufacture by "casting" of blocks of propellants. This process is highly suitable for manufacturing large charges for rocket motors, but is not suitable for serial manufacture of small articles on an industrial scale.

U.S. Pat. No. 4,405,534, for its part, describes a process of manufacture of plastic-bonded explosives by cold compression of granulates of explosives coated with a polyurethane film made plastic by virtue of the presence of plasticizers. Apart from the fact of being noncontinuous, this process has the additional disadvantage of requiring the presence of a high content of plasticizer, which is not always advantageous where energetics are concerned.

A semicontinuous process of manufacture, with solvent, for such products has been proposed by application WO94/05607, but the need to use a solvent which must subsequently be removed restricts the advantage of this process.

When a person skilled in the art wishes to use a solvent-free continuous process with heat-curable binders, he is confronted with the problem of the short "pot life" of these compositions which means that, after mixing the ingredients of the composition, he has only very little time to carry out the geometric forming of the product before the crosslinking of the binder rules out any mechanical working of the dough containing the various ingredients.

It has indeed been proposed to lengthen the "pot life" by retarding the final crosslinking, for example by portionwise addition of the crosslinking agent, as described in U.S. Pat. No. 4,657,607 or else by employing a double system of binders in which one of the systems is crosslinkable only by an energetic input other than heat, as described in patent application EP-A-0 367 445.

Nevertheless, the possibilities of application of these techniques are restricted and a person skilled in the art does not have available a general process for continuous and solvent-free manufacture of compound pyrotechnic products with a heat-curable binder.

The subject-matter of the present invention is precisely to propose such a process as well as an industrial plant enabling this process to be implemented.

The invention therefore relates to a continuous process for solvent-free manufacture of finished composite pyrotechnic products in which the starting constituents include especially a liquid binder which is crosslinkable at a temperature higher than 40° C. and at least one solid oxidizing energetic filler, the said process consisting especially:

i) in mixing the starting constituents of the said products so as to obtain a homogeneous composite dough of sufficient viscosity to be capable of retaining stable geometrical dimensions.

ii) in giving the dough thus obtained the form of intermediate products which have the geometrical dimensions of the finished products, iii) in setting the form and the composition of the intermediate products thus obtained by crosslinking the binder, and being characterized in that:

iv) the said starting liquid binder is first of all mixed with a solid thickening filler in pulverulent form so as to obtain a premix of greasy consistency which is subsequently mixed with the said energetic fillers, v) the mixing and forming operations are conducted at a temperature lower than 40° C.

In relation to the known processes of the prior art, the major originality of the process according to the invention lies in the fact that, with the exception of the final stage during which the structure and the composition of the intermediate products are set by crosslinking, the various operations are conducted at a temperature at which the binder is, chemically speaking, virtually unchanging. Thus, the formulation of the composition of the products is completely reproducible insofar as it is entirely performed at the beginning of the process without requiring any subsequent adjustment. A person skilled in the art is not confronted with any "pot life" condition and the intermediate products whose geometrical dimensions might be imperfect can be recycled into the manufacture.

Finally, it should be noted that, by virtue of the use of solid thickening fillers which give the unchanging liquid binder a sufficient mechanical strength, no plasticizer is necessary in the context of the present process, which thus makes it possible to obtain pyrotechnic products of very high performance.

It can also be said that, in contrast to the previous processes which employ a heat-curable binder that changes during the process and whose viscosity it is intended to lower by the use of a solvent and/or a plasticizer, the process according to the invention employs a liquid heat-curable binder which does not change during the process and whose apparent viscosity is raised by the use of thickening fillers.

According to a first preferred alternative form of the invention the said solid thickening filler consists of a porous material whose particle size is between 0.1 and 10 $\mu$m (microns) and whose specific surface is between 60 and 500 $m^2/g$.

This material will advantageously also have combustion-modifying properties and will be chosen from the group consisting of carbon black, colloidal silica, alumina, titanium oxide and polynorbornene.

According to this first alternative form the weight ratio of the said thickening filler to the said crosslinkable binder is between 0.05 and 0.25.

According to a second preferred alternative form of the invention the said solid thickening filler consists of a thermoplastic polymer containing hydrocarbon units which, in addition to the carbon and hydrogen atoms, may contain oxygen and nitrogen atoms, and whose weight-average molecular mass is between $3\times10^5$ and $3\times10^6$.

A first group of thermoplastic polymers which can be employed as solid thickening filler within the scope of the present invention thus consists of the styrene/butadiene/styrene, styrene/isoprene/styrene, styrene/ethylene/butylene/styrene and styrene/ethylene/propylene copolymers.

A second group of thermoplastic polymers that can be employed as solid thickening fillers within the scope of the present invention consists of polyurethanes containing polyether and polycarbonate units and of the polyether/polyamide block copolymers.

According to this second alternative form the weight ratio of the said thickening filler to the said crosslinkable binder is between 10:90 and 50:50.

In addition to the solid oxidizing energetic fillers it will also be possible to incorporate into the premix consisting of the liquid binder and the said thickening fillers at least one solid reducing energetic filler like, for example, aluminium or boron in powder form.

It is only when the operations of mixing and forming the intermediate products are finished and are judged to be satisfactory that the binder is changed by making it crosslink using heating to a temperature higher than 40° C. so as to obtain crosslinked finished products.

The process according to the invention thus makes it possible to obtain continuously, without any time constraint linked with questions of "pot life" and without use of solvents or plasticizers that are undesirable from the viewpoint of energetics, compound pyrotechnic products with a crosslinked binder. These products find their preferred applications as propellent powders in strand or stick form for ammunition intended for firearms, as blocks of propellants for rocket motors, as explosive charges for explosive ammunition or else as pyrotechnic charges for gas generators intended both for military applications and for civilian applications like motor vehicle safety.

The invention also relates to a plant that is particularly suitable for implementing the process according to the invention.

This plant is characterized in that it includes, in the direction of forward travel of the material:

i) a shearing roll mill consisting of two cylindrical rolls of identical length, carrying helical grooves and whose shafts are parallel and situated in the same horizontal plane while being spaced apart so as to allow a slot to remain between the two rolls which rotate in directions opposite to one another, ii) a positive delivery pump which brings the premix consisting of the liquid binder and the thickening filler to the material entry end of the roll mill, iii) at least one metering hopper discharging the solid energetic fillers onto the rolls of the roll mill between the material entry end and the material exit end of the latter, iv) a device for granulating the homogeneous dough thus formed, which is situated at the exit end of the roll mill, v) an extruder in which the granules originating from the granulating device are picked up, vi) a device for chopping into intermediate products the extruded reeds leaving the extruder, vii) a conveyor belt which ensures the conveying and carrying into a temperature oven of the intermediate products thus chopped.

A detailed description of the preferred embodiment of the process according to the invention is given below with reference to FIG. 1 which represents, diagrammatically, the preferred plant introduced below. For reasons of clarity, FIG. 2 shows a simplified top view of the shearing roll mill employed.

The invention therefore consists in mixing, at ambient temperature, the starting constituents of a crosslinkable composite pyrotechnic composition until a homogeneous composite dough is obtained exhibiting a sufficient viscosity to be capable, still at ambient temperature, of being formed into intermediate products which already exhibit, in a stable manner, the final form and dimensions of the finished product which it is intended to obtain. The form and the composition of these intermediate products are then set by crosslinking with heating so as to obtain the desired finished products.

BRIEF DESCRIPTION OF THE DRAWINGS

FIG. 1 also shows the premix (2) being conveyed by the pump (5) to the shearing roll mill (6). The premix (2) is then mixed with the solid energetic fillers (17) and a sheet of homogeneous dough is formed;

Figure 1:
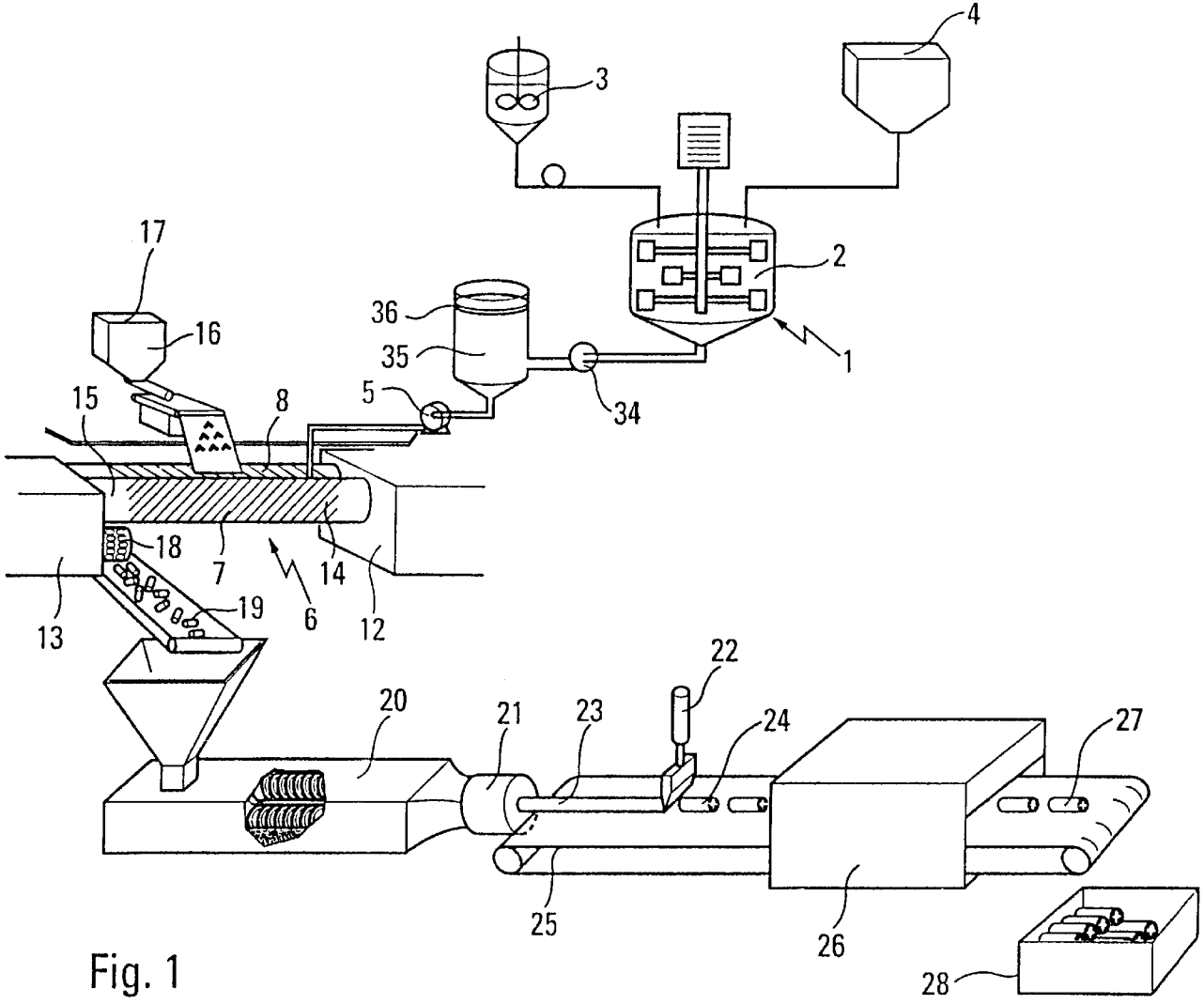
FIG. 1—illustrates the process of manufacturing in a multiblade mixer (1) a premix (2) consisting mainly of the heat-curable binder (3) in the liquid state and a thickening solid filler (4).
Figure 2:
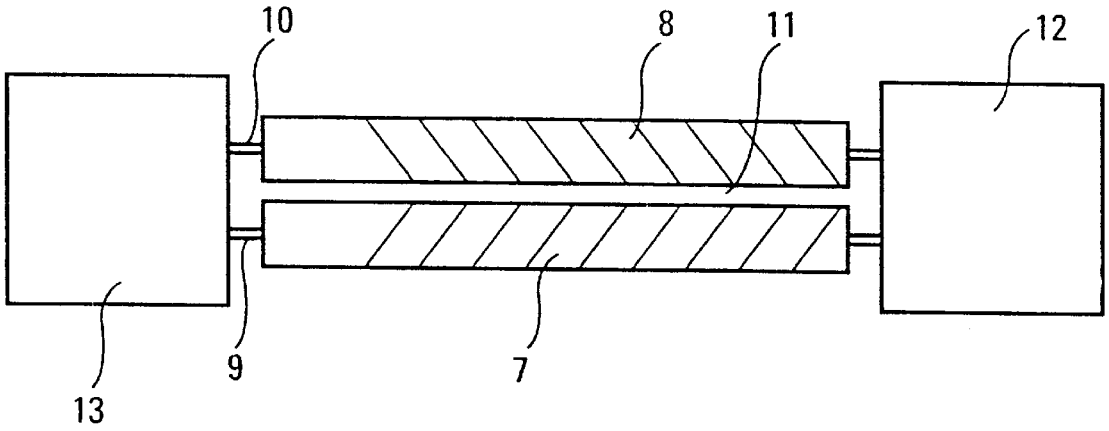
FIG. 2—shows in more detail the connection between support block (13), the shafts (9) and (10) driving the two cylindrical rolls (7) and (8) and the slot (11) which is formed between shafts (9) and (10).

To do this, the starting point is, as shown in FIG. 1, manufacturing in a multiblade mixer 1 a premix 2 consisting chiefly of the heat-curable binder 3 in the liquid state and of the thickening solid fillers 4.

It is absolutely essential within the scope of the present invention that the heat-curable binder should be liquid at ambient temperature and that its crosslinking can begin only at a temperature higher than 40° C., so as to make sure that, so long as it remains at an ambient temperature lower than 40° C., this binder will remain chemically unchanging.

In the present description "liquid binder" is intended to mean all of the liquid reactive constituents which, after crosslinking, will give the solid crosslinked binder.

The crosslinking reaction may be of the polycondensation reaction type, in which case the binders will be especially of the polyurethane, polyester or polyamide type.

The crosslinking reaction may be of the poly-addition reaction type with opening of ethylenic unsaturations, in which case the binders will be especially of the polyalkylene, polyacrylate or polymethacrylate type. In this latter case the composition will need to contain crosslinking catalysts like, for example, peroxides.

As already indicated above in the description, the said thickening fillers may consist of porous solid materials of small particle size. In this case some additives usually employed as combustion modifiers, like carbon black, will be advantageously employed as thickening fillers; the process according to the invention in this case offers the advantage of making it possible to obtain continuously pyrotechnic compositions which are already known but which were accessible only by non-continuous processes.

The said thickening fillers can also consist of solid thermoplastic polymers of high molecular mass, so as to obtain a final product in which the binder consists of a blend of thermoplastic polymers and of crosslinked polymers. This type of blend makes it possible to obtain compound products exhibiting particularly high mechanical characteristics.

The premix 2 thus formed may also contain other additives of the final composition. It must have the consistency of a thick grease, so as to be capable of being continuously conveyed by means of a positive delivery pump while adhering, without running, to the surface of a roll rotating at an angular rate of several tens of revolutions per minute.

This premix is therefore conveyed by means of a circulating pump 34, for example a gear pump, into a storage unit 35 provided with a plunger lid 36. The premix is then picked up by a metering gear pump 5 to be led into equipment in which will be performed the operations of mixing with the solid energetic fillers and of forming the compound dough thus obtained into the form of intermediate products which already have the geometrical dimensions of the finished products. These two operations can be performed in a single piece of equipment like, for example, a twin-screw extruder whose extrusion head will be used in combination with a chopping device. However, prefer-ably, these two operations will be performed by two separate pieces of equipment placed one following the other.

The premix 2 is conveyed by the pump 5 into a mixer which may be a conventional mixer such as a Buss co-kneader but which, preferably and as shown in FIG. 1, is a shearing roll mill 6 consisting of two cylindrical rolls 7 and 8 of identical length and carrying helical grooves. The shafts 9 and 10 of these two rolls are parallel and situated in the same horizontal plane, being spaced apart so as to leave a slot 11 between the two rolls. The shafts 9 and 10 are supported by support blocks 12 and 13, block 12 being a drive block driving in rotation the two rolls 7 and 8 which rotate in opposite directions to one another at different speeds. Such a shearing roll mill is known to a person skilled in the art and described in many publications, for example in the Patent Application FR-A-2 723 086, already cited.

The pump 5 thus brings the premix 2 onto the roll 7, which turns faster, the premix forming on this roll a sheet which coats the latter. The premix is brought to the material entry end 14 of the roll mill 6.

At least one metering hopper 16 discharges, between the material entry end 14 and the material exit end 15 of the roll mill 6, the solid energetic fillers 17 onto the sheet of premix coating the roll 7. These solid energetic fillers are then intimately mixed with the premix 2 by virtue of the shearing action of the roll mill 6 so as to form on the roll 7 a sheet of homogeneous compound dough which already has a sufficient viscosity to be able to retain stable geometrical dimensions.

The solid energetic fillers will consist chiefly of the oxidizing fillers of the composition, which may be inorganic fillers like, for example, ammonium perchlorate, potassium perchlorate or ammonium nitrate, or organic fillers and especially nitramines like RDX, HMX, nitroguanidine or hexanitrohexaazaisowurtzitane.

Beside the solid oxidizing fillers there may be solid reducing energetic fillers like aluminium or boron and even solid additives which would not have been incorporated into the premix 2.

In this case the various fillers can be introduced either as a mixture by a single hopper or separately by a succession of hoppers.

The sheet of composite dough thus obtained is recovered in the form of granules 19 by a granulating device 18 situated at the exit end 15 of the roll mill 6. As shown in FIG. 1, the exit ends of the rolls 7 and 8 are preferably not grooved but are smooth.

The granules 19 are then picked up continuously in an extruder 20, for example a twin-screw extruder fitted with an extrusion head 21 in order to be formed into reeds 23 entering by a conveyor belt 25.

A chopping device 22 cuts the formed reeds 23 leaving the extrusion head 21 into intermediate products 24 which already have the definitive dimensions of the finished products. The chopping device 22 has a movement servo-controlled by the speed of forward travel of the belt 25 on which the reeds 23 lie.

It should be noted that until this chopping operation no heating of the pyrotechnic composition has taken place, it being possible for the extruder 20 even to be cooled. The binder of the pyrotechnic composition has therefore not changed and the intermediate products 24 can be recycled into the manufacturing circuit if they are judged to be unsatisfactory.

When they are judged to be satisfactory, these intermediate products 24 are then continuously picked up by the conveyor belt 25 which provides their transport and their entry into a heating oven 26, where their geometrical form and their composition are definitively set by crosslinking of their binder, at a temperature higher than 40° C. With the usual compositions known to a person skilled in the art the crosslinking will often be performed at a temperature close to 120° C. for approximately 5 minutes.

The finished products 27 leaving the oven 26 can then be packed in their package 28.

The process according to the invention thus makes it possible to manufacture in continuous series composite pyrotechnic products containing a crosslinked binder, and especially products of small dimensions, without any "pot life" constraint, without solvent and without undesirable plasticizer.

The examples which follow illustrate some possibilities of implementation of the invention.

The following abbreviations have been employed in these examples:

HEPB=binder based on polybutadiene with hydroxyl ends, crosslinked with a polyisocyanate PGA=binder based on polyglycidyl azide with hydroxyl ends, crosslinked with a polyisocyanate S.B.S.=styrene/butadiene/styrene copolymer S.I.S.=styrene/isoprene/styrene copolymer PE-PA=60/40 polyether/polyamide block copolymer

RDX=RDX

AP=ammonium perchlorate

All the percentages shown in the examples are mass percentages, the percentages shown in the case of the binder including any additives employed.

EXAMPLES 1 to 3

Cylindrical powder strands multiperforated with 7 holes and with 19 holes were manufactured by the continuous process according to the invention from the following three compositions:

| | Composition 1 | Composition 2 | Composition 3 |
|---|---|---|---|
| binder | HEPB:9% | HEPB:10.5% | PGA:13% |
| thickening filler | S.I.S. 6% | PE-PA:4.5% | PE-PA:7% |
| oxidizing filler | RDX 85% | RDX 85% | RDX 80% |
| particle size of the oxidizing filler | 100 μm | 150 μm | 80 μm |
| reducing filler | 0 | 0 | 0 |

With a material temperature of 35° C. during the extrusion, the following geometries were obtained:

| | | 7 holes | 19 holes |
|---|---|---|---|
| Composition 1 | web (mm) | 0.34 ± 0.01 | 1.48 ± 0.01 |
| | d (mm) | 0.29 ± 0.005 | 0.40 ± 0.01 |
| Composition 2 | web (mm) | 0.35 ± 0.01 | 1.51 ± 0.01 |
| | d (mm) | 3.30 ± 0.005 | 0.40 ± 0.005 |
| Composition 3 | web (mm) | 0.34 ± 0.01 | 1.49 ± 0.01 |
| | d (mm) | 0.31 ± 0.005 | 0.39 ± 0.01 |

web = burning thickness
d = hole diameter

EXAMPLES 4 to 6

Cylindrical propellant blocks with a central channel for small-missile motors were manufactured by the continuous process according to the invention from the following three compositions:

| | Composition 4 | Composition 5 | Composition 6 |
|---|---|---|---|
| binder | HEPB: 10% | HEPB: 12.2% | HEPB: 10.5% |
| thickening filler | Polynorbornene = 4% | Carbon black (150 $m^2/g$): 1.8% | Porous alumina (80 $m^2/g$):3.5% |
| oxidizing filler | PA:85% | PA:85% | PA:85% |
| reducing filler | A1:1% | A1:1% | A1:1% |

The die was a cylindrical die of 30 mm external diameter and 14 mm internal diameter.

Over 10 meters of propellant extruded continuously using each of the compositions the dimensional variations obtained after chopping and crosslinking with heating are the following:

| | Example 4 | Example 5 | Example 6 |
|---|---|---|---|
| external diameter in mm | 30.5 ± 0.002 | 30.0 ± 0.02 | 29.9 ± 0.02 |
| internal diameter in mm | 13.8 ± 0.003 | 13.9 ± 0.02 | 14.05 ± 0.02 |
| length in mm | 121 ± 0.1 | 120.5 ± 0.15 | 120.4 ± 0.1 |

EXAMPLE 7

Strips of plastic-bonded explosive of thickness between 2 and 5 mm were manufactured by the continuous process according to the invention from the following composition:

HEPB binder=11% thickening filler=SIS=4% oxidizing filler: RDX (3 μm and 90 μm)=85%

10 meters of 90 mm wide strip with thicknesses of 2.3 and 5 mm were extruded continuously. After crosslinking of the binder the dimensional variation of the strips was:

| | extrusion thickness 2 mm | extrusion thickness 3 mm | extrusion thickness 5 mm |
|---|---|---|---|
| Thickness in mm | 1.98 ± 0.01 | 2.95 ± 0.015 | 4.99 ± 0.02 |
| Width in mm | 89.5 ± 0.05 | 90.2 ± 0.06 | 89.8 ± 0.04 |

EXAMPLE 8

Blocks of propellants for a pyrotechnic gas generator were manufactured by the continuous process according to the invention from the following composition:

HEPB binder: 15.8% thickening filler=SBS: 9.2% oxidizing filler: PA (90 μm, 15 μm, 3 μm): 73% reducing filler: Al=2%

The blocks were in the shape of solid cylinders with dimensions:

diameter: 30 mm+0.025 mm length: 90 mm+0.10 mm

These blocks were fired on a test bench and gave the following results:

burning speed at 13 MPa=25.3 mm/s pressure exponent=0.35

We claim:

1. Continuous process for solvent-free manufacture of finished composite pyrotechnic products in which the starting constituents include especially a liquid binder which is crosslinkable at a temperature higher than 40° C. and at least one solid oxidizing energetic filler, the process consisting especially:

i) in mixing the starting constituents of the said products so as to obtain a homogeneous composite dough of sufficient viscosity to be capable of retaining stable geometrical dimensions.

ii) in giving the dough thus obtained the form of intermediate products which have the geometrical dimensions of the said finished products, iii) in setting the form and the composition of the intermediate products thus obtained by crosslinking the binder, characterized in that:

iv) the said starting liquid binder is first of all mixed with a solid thickening filler in pulverulent form so as to obtain a premix of greasy consistency which is subsequently mixed with the said energetic fillers, v) the mixing and forming operations are conducted at a temperature lower than 40° C.

2. Process according to claim 1, characterized in that the said solid thickening filler consists of a porous material whose particle size is between 0.1 and 10 $\mu$m and whose specific surface is between 60 and 500 $m^2/g$.

3. Process according to claim 2, characterized in that the said material is chosen from the group consisting of carbon black, colloidal silica, alumina, titanium oxide and polynorbornene.

4. Process according to claim 1, characterized in that the said solid thickening filler consists of a thermoplastic polymer containing hydrocarbon units which may contain oxygen and nitrogen atoms, whose weight-average molecular mass is between $3\times10^5$ and $3\times10^6$.

5. Process according to claim 4, characterized in that the said thickening filler is chosen from the group consisting of styrene/butadiene/styrene, styrene/isoprene/styrene, styrene/ethylene/butylene/styrene and styrene/ethylene/propylene copolymers.

6. Process according to claim 4, characterized in that the said thickening filler is chosen from the group consisting of polyurethanes based on polyethers and on polycarbonates and of polyether/polyamide block copolymers.

7. Process according to claim 4, characterized in that the weight ratio of the said thickening filler to the said crosslinkable binder is between 10:90 and 50:50.

8. Process according to claim 2, characterized in that the weight ratio of the said thickening filler to the said crosslinkable binder is between 0.05 and 0.25.

9. Process according to claim 1, characterized in that, in addition to the said solid oxidizing energetic fillers, at least one solid reducing energetic filler is employed.

10. Process according to claim 9, characterized in that the said reducing energetic filler consists of aluminium or boron in powder form.

11. Plant for implementing the process according to claim 1, characterized in that it includes, in the direction of forward travel of the material:

i) a shearing roll mill consisting of two grooved cylindrical rolls (7, 8) of identical length, carrying helical grooves and whose shafts are parallel and situated in the same horizontal plane while being spaced apart so as to leave a slot (11) between the two rolls which rotate in directions opposite to one another, ii) a positive delivery pump (5) which brings the premix (2) consisting of the liquid binder and the thickening filler to the material entry end (14) of the roll mill (6), iii) at least one metering hopper (16) discharging the solid energetic fillers (17) onto the rolls of the roll mill (6) between the material entry end (14) and the material exit end of the latter, iv) a device (18) for granulating the homogeneous dough thus formed, which is situated at the exit end (15) of the roll mill, v) an extruder (20) in which the granules originating from the granulating device are picked up, vi) a device (22) for chopping into intermediate products (24) the extruded reeds (23) leaving the extruder, vii) a conveyor belt (25) which ensures the conveying and entry into a heating oven (26) of the intermediate products thus chopped.

* * * * *